US010176824B2

(12) United States Patent
Pandey et al.

(10) Patent No.: US 10,176,824 B2
(45) Date of Patent: Jan. 8, 2019

(54) METHOD AND SYSTEM FOR CONSONANT-VOWEL RATIO MODIFICATION FOR IMPROVING SPEECH PERCEPTION

(71) Applicant: Indian Institute of Technology Bombay, Powai, Mumbai, Maharashtra (IN)

(72) Inventors: Prem Chand Pandey, Mumbai (IN); Ammanath Ramakrishnan Jayan, Kerala (IN); Nitya Tiwari, Mumbai (IN)

(73) Assignee: Indian Institute of Technology Bombay, Mumbai (IN)

( * ) Notice: Subject to any disclaimer, the term of this patent is extended or adjusted under 35 U.S.C. 154(b) by 176 days.

(21) Appl. No.: 15/121,599

(22) PCT Filed: Jan. 27, 2015

(86) PCT No.: PCT/IN2015/000048

§ 371 (c)(1),
(2) Date: Aug. 25, 2016

(87) PCT Pub. No.: WO2015/132798

PCT Pub. Date: Sep. 11, 2015

(65) Prior Publication Data

US 2016/0365099 A1 Dec. 15, 2016

(30) Foreign Application Priority Data

Mar. 4, 2014 (IN) ..... 739/MUM/2014

(51) Int. Cl.
*G10L 21/0232* (2013.01)
*G10L 21/02* (2013.01)
(Continued)

(52) U.S. Cl.
CPC ..... *G10L 21/0232* (2013.01); *G10L 21/0205* (2013.01); *G10L 21/0264* (2013.01);
(Continued)

(58) Field of Classification Search
None
See application file for complete search history.

(56) References Cited

U.S. PATENT DOCUMENTS 4,454,609 A 6/1984 Kates
5,737,719 A 4/1998 Terry
(Continued)

OTHER PUBLICATIONS

International Search Report dated Aug. 25, 2016 in corresponding International Patent Application No. PCT/IN2015/000048.
(Continued)

*Primary Examiner* — Richa Mishra
(74) *Attorney, Agent, or Firm* — Pepper Hamilton LLP

(57) ABSTRACT

Increasing the level of the consonant segments relative to the nearby vowel segments, known as consonant-vowel ratio (CVR) modification, is reported to be effective in improving speech intelligibility by listeners in noisy backgrounds and by hearing-impaired listeners. A method along with a system for real-time CVR modification using the rate of change of spectral centroid for detection of spectral transitions is disclosed. A preferred embodiment of the invention using a 16-bit fixed point processor with on-chip FFT hardware is also presented for real-time signal processing. It can be integrated with other FFT-based signal processing in communication devices, hearing aids, and other systems for improving speech perception under adverse listening conditions.

14 Claims, 7 Drawing Sheets

(51) Int. Cl.

| | |
|---|---|
| ***G10L 21/0264*** | (2013.01) |
| ***G10L 21/0364*** | (2013.01) |
| ***G10L 25/21*** | (2013.01) |
| ***G10L 25/87*** | (2013.01) |

(52) U.S. Cl.
CPC ..... *G10L 21/0364* (2013.01); *G10L 25/21* (2013.01); *G10L 25/87* (2013.01)

(56) References Cited

U.S. PATENT DOCUMENTS

| | | | | |
|---|---|---|---|---|
| 6,889,186 | B1 | 5/2005 | Michaelis | |
| 8,296,154 | B2 | 10/2012 | Vandali et al. | |
| 2009/0168939 | A1* | 7/2009 | Constantinidis | H04W 52/028 375/359 |
| 2011/0051924 | A1* | 3/2011 | LeBlanc | H04B 3/23 379/406.06 |
| 2011/0191101 | A1* | 8/2011 | Uhle | G10L 21/0208 704/205 |
| 2011/0286618 | A1* | 11/2011 | Vandali | A61N 1/36032 381/320 |
| 2012/0281863 | A1* | 11/2012 | Iwano | H04R 25/00 381/321 |
| 2013/0143618 | A1* | 6/2013 | Seshadri | G10L 19/12 455/550.1 |
| 2013/0218568 | A1* | 8/2013 | Tamura | G10L 13/033 704/260 |
| 2013/0282379 | A1* | 10/2013 | Stephenson | G10L 17/26 704/270 |

OTHER PUBLICATIONS

Skowronski et al., "Applied principles of clear and Lombard speech for automated intelligibility enhancement in noisy environments," Journal of Speech Communication, vol. 48, pp. 549-558, 2006.
Colotte et al., "Automatic enhancement of speech intelligibility," Proceedings of ICASSP 2000, Istanbul, pp. 1057-1060.
Yoo et al., "Speech signal modification to increase intelligibility in noisy environment," Journal of Acoustical Society of America, vol. 122, pp. 1138-1149, 2007.
Tantibundhit et al., "Speech enhancement based on joint time-frequency segmentation," Proceedings of ICASSP 2009, Taipei, pp. 4673-4676.

* cited by examiner

METHOD AND SYSTEM FOR CONSONANT-VOWEL RATIO MODIFICATION FOR IMPROVING SPEECH PERCEPTION

This application is a national phase filing under 35 U.S.C. § 371 of International Patent Application No. PCT/IN2015/000048, filed Jan. 27, 2015, which claims the benefit of Indian Patent Application No. 739/MUM/2014, filed Mar. 4, 2014, each of which is incorporated herein by reference in its entirety.

FIELD OF THE INVENTION

The present invention generally relates to signal processing and more particularly to a method and system for improving the speech intelligibility under adverse listening conditions.

BACKGROUND OF THE INVENTION

It has been observed that a talker in a difficult communication environment usually alters the speaking style to make the speech more intelligible. The resulting speech is known as "clear speech". Studies have shown that, in comparison to the conversational style speech, it is more intelligible for listeners in noisy backgrounds and for listeners with hearing impairment, children with learning disabilities, and non-native listeners. Increased consonant intensity and duration have been identified as the main contributors to the intelligibility advantage of clear speech. Studies using modification of conversational speech have shown that enhancement of consonant intensity resulted in improved speech intelligibility, while duration modification resulted in only marginal improvements, possibly due to errors in locating the boundaries of segments to be modified and due to processing related artifacts. It may also be due to the fact that formants in conversational speech are relatively less targeted which cannot be improved by duration modification.

Increasing the intensity of consonant segments relative to the nearby vowel segments is known as consonant-vowel ratio (CVR) modification. It is reported to be effective in improving perception of consonants, across speakers and vowel context dependencies, for listeners in noisy backgrounds and for hearing-impaired listeners. The techniques for CVR modification can be broadly classified into manual and automated depending on the methods used for locating the segments for modification. The manual techniques are useful in investigating the effectiveness of CVR modification in improving speech perception. Results of investigations with such techniques have shown that a significant improvement in speech intelligibility can be achieved by accurate selection and careful modification of perceptually salient segments in conversational speech. Automated techniques for CVR modification, implemented for real-time processing, can be useful for enhancing speech intelligibility in communication devices and hearing aids. For being useful in such applications, the technique should meet the following requirements: (i) the segments for modification should be detected with a high temporal accuracy and low rate of insertion errors and without being significantly affected by speaker variability, (ii) modification of speech characteristics should be carried out without introducing perceptible distortions, (iii) the processing should have low computational complexity and memory requirement to enable real-time processing using the processors available in communication devices and hearing aids, (iv) the signal delay introduced by the processing (processing delay consisting of the algorithmic and computational delays) should not be disruptive for audio-visual speech perception. These requirements are only partly met by the existing systems.

Kates (J. M. Kates, "Speech intelligibility enhancement," U.S. Pat. No. 4,454,609, 1984) has described a method for enhancement of intelligibility of consonant sounds in communication systems by boosting high frequency components. The system comprises a bank of band-pass filters and envelope detectors, a controller to set the gain for each filter channel, by comparing its short-time energy with those of the selected reference channels, and application of these gains for dynamically modifying the overall spectral shape. Reference channels are selected for boosting the short-time energy of the high frequency channels with respect to the low frequency channels. Thus the method enhances the sounds characterized by high frequency release bursts and transitions and not all transient segments. Further, use of fixed frequency bands in the processing limits its adaptability to speaker variability.

Terry (A. M. Terry, "Method and apparatus for enhancement of telephonic speech signals," U.S. Pat. No. 5,737,719, 1998) has described a system for boosting the second formant with respect to the first formant and modification of the consonant-vowel ratio. Processing uses a bank of bark-scale based band-pass filters. Short-time band energies are used to get an approximation of the auditory spectrum. Peak-picking is applied to locate first two formants and the second formant is enhanced with respect to the first one. Segments having energy levels below those associated with vowels but above those associated with silence are identified as consonantal and these are amplified. Auditory spectrum is converted to Fourier spectrum and inverse Fourier transform is used to produce the output. Although the method is suitable for real-time processing, errors in formant identification, errors in selecting consonantal segments, and use of analysis-synthesis, particularly conversion from auditory spectrum to Fourier spectrum and discarding of the phase information, are likely to result in processing related artifacts. Further, use of fixed bands in the method limits its adaptability to speech and speaker variability.

Michaelis (P. R. Michaelis, "Method and apparatus for improving the intelligibility of digitally compressed speech," U.S. Pat. No. 6,889,186B1, 2005) has described a method which involves segmenting input speech into frames, carrying out spectral analysis to identify the type of sound in each frame, and applying a gain based on the type of sound in the frame and in the surrounding frames, to improve speech intelligibility. Frames identified as unvoiced fricatives and plosives are amplified and the preceding voiced frames are attenuated. This method does not address enhancement of voiced stops and fricatives which may be hard to perceive under adverse listening conditions. Fixed-frame based segmentation may cause short duration release bursts to get merged with the voiced segments, resulting in errors in classification of frames, thereby limiting the effectiveness of the modification in improving speech intelligibility. Further, need for classification of the frames increases computational complexity and dependence of the gain of a frame on the type of neighbouring frames causes excessive signal delay.

Vandali et al. (A. E. Vandali, G. M. Clark, "Emphasis of short-duration transient speech features," U.S. Pat. No. 8,296,154B2, 2012) have described a transient emphasis system for use in auditory prostheses to assist in perception of low-intensity short-duration speech features. The method uses a bank of band-pass filters and envelope detectors. For each filter channel, a running history buffer of the envelope spanning 60 ms with 2.5 ms intervals is used to estimate its second derivative which is used to determine a channel gain function. As the method uses fixed frequency bands, it is not adaptive to speech and speaker variability and it also suffers from a relatively large signal delay.

Skowronski et al. (M. D. Skowronski, J. G. Harris, "Applied principles of clear and Lombard speech for automated intelligibility enhancement in noisy environments," Journal of Speech Communication, vol. 48, pp. 549-558, 2006) reported a method for speech intelligibility enhancement based on redistribution of energy in voiced and unvoiced segments. In this method, a measure of spectral flatness derived from the short-time speech spectrum along with a Schmitt trigger based thresholding is used for classifying the segments as voiced or unvoiced. The voiced segments (those corresponding to vowels, semivowels, nasals, voiced plosives, and voiced fricatives) are attenuated and unvoiced segments are amplified, maintaining the overall energy unaltered. Possible errors in classification and sensitivity of the classification method to additive noise are the limiting factors in its usefulness in enhancing the unvoiced segments. Further, attenuation of the low-energy voiced plosives and fricatives may adversely affect their perception. Colotte et al. (V. Colotte, Y. Laprie, "Automatic enhancement of speech intelligibility," Proceedings of ICASSP 2000, Istanbul, pp. 1057-1060) have reported a method using spectral variation function based on mel-cepstral analysis to locate stop and fricative segments and their amplification by 4 dB. In a method reported by Yoo et al. (S. D. Yoo, J. R. Boston, A. Jaroudi, C. C. Li, "Speech signal modification to increase intelligibility in noisy environment," Journal of Acoustical Society of America, vol. 122, pp. 1138-1149, 2007), the transient regions of speech are extracted and emphasized using time-varying band-pass filters based on formant tracking. Tantibundhit et al. (C. Tantibundhit, F. Pernkopf, G. Kubin, "Speech enhancement based on joint time-frequency segmentation," Proceedings of ICASSP 2009, Taipei, pp. 4673-4676) have described a method for speech modification based on wavelet packet decomposition. These methods are computation intensive and introduce significant signal delays.

In view of the foregoing, there is a need for a new method and system for consonant-vowel ratio modification without introducing perceptible distortions for improving speech intelligibility.

OBJECTIVE OF THE INVENTION

1. It is primary objective of present invention to provide a method for consonant-vowel ratio modification for improving speech perception under adverse listening conditions.
2. It is another objective of present invention to provide a system for consonant-vowel ratio modification for improving speech perception under adverse listening conditions.
3. It is another objective of present invention to modify the characteristics of perceptually salient segments in speech without introducing perceptible distortion.
4. It is another objective of present invention to detect the segments in speech for modification with a high temporal accuracy and low rate of insertion errors and without being significantly affected by speaker variability.
5. It is another objective of present invention to provide a method for consonant-vowel ratio modification with low computational complexity and memory requirement and with a low signal delay for real-time processing in communication devices and hearing aids.

SUMMARY OF THE INVENTION

The present invention proposes a method and system for consonant-vowel ratio modification for improving speech perception under adverse listening conditions, such as those experienced by listeners in noisy backgrounds, hearing-impaired listeners, children with learning disabilities, and non-native listeners. It uses signal processing for enhancing the consonant-vowel ratio in speech signal by applying a gain function on the signal in time-domain and it introduces minimal perceptible distortions. The technique, presented in this disclosure, comprises the steps of (i) detection of perceptually salient segments for modification in digital speech signal, (ii) calculation of time-varying gain in accordance with the location of the detected segments for modification, and (iii) application of the calculated gain to the signal for improving its perception under adverse listening conditions. The segments for modification, consisting of the stop release and frication burst, are detected with a high temporal accuracy and low error rate, using the rate of change of spectral centroid derived from the short-time magnitude spectrum of speech added with a tone. The processing steps have low computational complexity and memory requirement. The method for detecting perceptually salient segments and calculation of time-varying gain have steps of windowing the samples of digital speech signal to form overlapping frames and calculating energy of the frames, smoothening the frame energy by a moving-average filter to get smoothened short-time energy and applying a peak detector with exponential decay on frank energy to track peak energy, generating a low-frequency tone and multiplying the low-frequency tone with peak energy and adding the resulting scaled tone to the digital speech signal to obtain a tone-added signal, windowing the tone-added signal and applying Discrete Fourier transform (DFT) to obtain short-time magnitude spectrum of the tone-added signal, applying a moving-average filter on the short-time magnitude spectrum to get smoothened short-time magnitude spectrum, calculating spectral centroid of the smoothened short-time magnitude spectrum, smoothening the spectral centroid by median filtering to get smoothened spectral centroid, calculating first-difference of the smoothened spectral centroid to get the rate of change of smoothened spectral centroid, and selecting said time-varying gain using said smoothened short-time energy, said peak energy, and said rate of change of spectral centroid.

The signal delay introduced by the processing is acceptable for audio-visual perception and hence the method is suitable for real-time processing of speech signals in communication devices and hearing aids. In an aspect of the present invention, a system provides consonant-vowel ratio (CVR) modification using a 16-bit fixed-point processor with on-chip FFT hardware and interfaced to an audio codec for inputting the speech signal as analog audio input from a microphone and outputting the processed speech signal as analog audio output through a speaker. The preferred embodiment can be integrated with other FFT based speech enhancement techniques like noise suppression and dynamic range compression for use in communication devices, hearing aids, and other audio devices.

DETAILED DESCRIPTION

The present invention proposes a method and a system for consonant-vowel ratio modification for improving speech perception under adverse listening conditions and for use in communication devices and hearing aids. The processing technique assumes clean speech at a conversational level to be available as the input signal. In case of noisy input, the processing may be used along with a speech enhancement technique for noise suppression. In case of input with wide variation in the signal level, a dynamic range compression technique may be used. The processing is applied to make the speech signal robust against further degradation under adverse listening conditions and it does not adversely affect the perception of non-speech audio signals. The processing method along with the system is explained below with reference to the accompanying drawings in accordance with an embodiment of the present invention.

Figure 1:
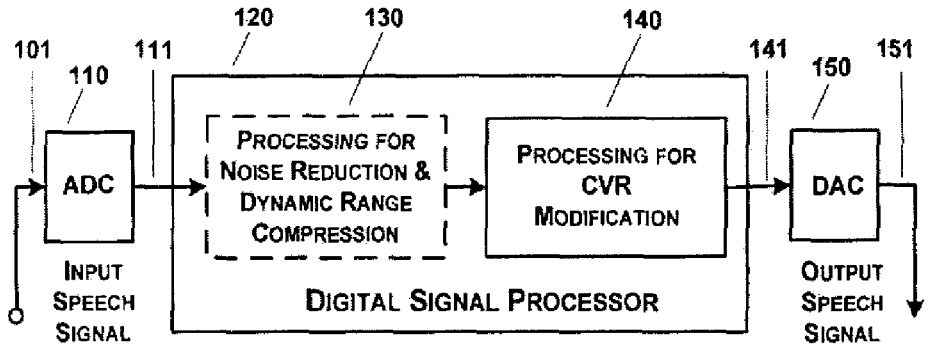
FIG. 1 is a schematic illustration of the CVR modification system in accordance with an aspect of the present invention.

FIG. 1 is a schematic illustration of the CVR modification system in accordance with an aspect of the present invention. It consists of an analog-to-digital converter (ADC) 110, digital signal processor 120, and digital-to-analog converter (DAC) 150. The input speech signal obtained as analog audio input 101 from an input device such as a microphone and amplifier is converted to digital signal 111 and applied as input for signal processing implemented on the digital signal processor 120. The signal processing consists of the processing block 140 for CVR modification and it may optionally include the processing block 130 for noise reduction to suppress the background noise in the input signal and dynamic range compression to reduce the level differences between the low level and high level sounds. The processed digital signal 141 is output through the DAC 150 as analog audio output 151 to an output device such as an amplifier and speaker.

For CVR modification, the spectral transitions of interest need to be detected with a good temporal accuracy and without a significant effect of speaker variability. The processing associated with the detection of segments and their modification should have low computational complexity and memory requirement. Further, the algorithmic and computational delays associated with the processing should be low in order to be acceptable for use in speech communication devices. In a study on the use of the first four spectral moments for detection of stop release bursts, the spectral centroid was found to be the most significant contributor. It is the first moment of the distribution of spectral power and is related to the spectral slope. It is close to the center frequency for a flat spectrum and shifts towards the frequencies of highest power in a tilted spectrum. Its value is generally less than 0.5 kHz for vowels, semivowels, and nasals, greater than 0.5 kHz for voiced and unvoiced stops, and greater than 1 kHz for voiced and unvoiced fricatives. In the present invention, the peaks in the rate of change of spectral centroid are used for detecting the segments with sharp spectral transitions which are associated with major changes in the vocal tract configuration and occur at the release of closures in stops and affricates, and also in fricatives and nasals. The segments for modification are detected without labeling them.

The short-time spectrum is calculated by applying discrete Fourier transform (DFT) on windowed frames of the input signal. The spectral centroid $F_c(n)$ of the nth frame of the speech signal is calculated by using the following equation:

$$F_c(n) = \left( \sum_{k=1}^{N/2} kX(n,k) \Big/ \sum_{k=1}^{N/2} X(n,k) \right) f_s / N \tag{1}$$

where X(n,k) is the short-time magnitude spectrum, k is the frequency index, N is the DFT size, and $f_s$ is the sampling frequency. The centroid values obtained from spectra of short frame lengths (5-10 ms) are more sensitive to the changes in formant structure than to the harmonic structure, and hence are better suited for locating the spectral transitions associated with major changes in the vocal tract configuration. The rate of change of centroid is computed using a first difference with time step K using the following equation:

$$dF_c(n) = F_c(n) - F_c(n-K) \tag{2}$$

In the preferred embodiment of the invention, the input speech signal is sampled at $f_s$ of 10 kHz. The centroid computation is carried out using 6 ms frames with Hanning window and frame shift of 1 ms. A relatively large DFT size N of 512 is used for calculating the spectrum as it helps in a fine tracking of the change in the centroid obtained from the frame-averaged spectra.

Figure 2:
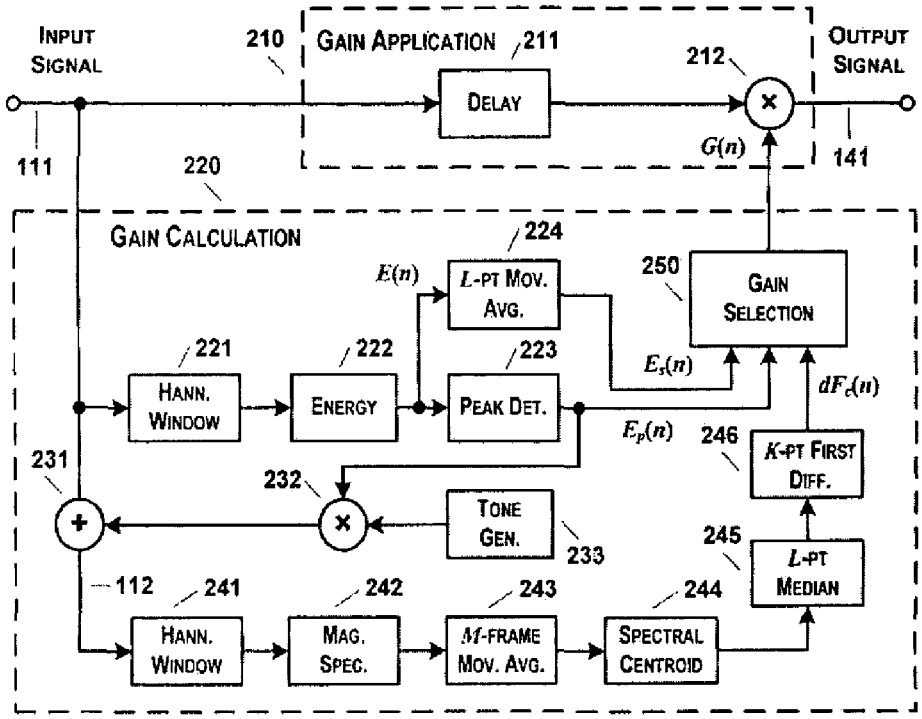
FIG. 2 is a schematic illustration of signal processing for CVR modification in accordance with an aspect of the present invention.

FIG. 2 is a schematic illustration of signal processing for CVR modification. The digital input signal 111 is applied to two signal processing paths, gain application path 210 and gain calculation path 220. The gain application path 210 consists of the processing blocks 211 and 212. The gain calculation path 220 consists of the processing blocks 221, 222, 223, 224, 231, 232, 233, 241, 242, 243, 244, 245, 245, 246, and 250. In the gain calculation path, the Hanning window 221 is applied on the input signal 111 and the windowed samples are applied to the frame energy calculator 222 to get the frame energy E(n) as the sum of the squares of the samples. The frame energy E(n) is applied as input to the peak detector 223 to get the peak energy $E_p(n)$. The peak detector tracks the envelope of the frame energy using an exponential decay using the following equation:

$$E_p(n) = E(n),\ E(n) \geq E_p(n-1)$$

$$\alpha E_p(n-1),\ \text{otherwise} \tag{3}$$

Use of $\alpha = 0.5^{(1/200)}$, with frame shift of 1 ms, corresponds to half-value release time of 200 ms and the resulting $E_p(n)$ tracks the vowel energy and retains it during stop closures and other low energy clusters. The frame energy E(n) is smoothened by the L-point moving average filter 224 to get the smoothened short-time energy $E_s(n)$.

A 100 Hz tone is generated by the tone generator 233 and its output is scaled by the multiplier 232 to get the tone at a level of −20 dB with reference to the peak energy $E_p(n)$. This tone is added using the adder 231 to the input signal 111 to obtain a tone added signal 112. Hanning window 241 is applied on this signal and N-point DFT is used by the magnitude spectrum calculator 242 to get the magnitude spectrum which is applied as input to the M-frame moving average filter 243 to get smoothened magnitude spectrum. It is applied to spectral centroid calculator 244, which calculates the spectral centroid using Equation-1. The output of the spectral centroid calculator 244 is smoothened by the L-point median filter 245 for suppressing ripples without significantly smearing the changes due to major spectral transitions. For detecting changes in the spectral centroid, the K-point first difference calculator 246 calculates $dF_c(n)$ using Equation-2. In the preferred embodiment of the invention, values of K, L, and M are set to correspond to time-step of 20 ms, i.e., K=L=M=20 for frame shift of 1 ms, as it was found to be optimal for detecting spectral transitions.

The gain to be applied at frame position n is calculated by the gain selector 250 using three inputs: first difference of spectral centroid $dF_c(n)$, smoothened short-time energy $E_s(n)$, and peak energy $E_p(n)$. The gain selection for CVR modification uses a hysteresis-based thresholding of $dF_c(n)$ with upper and lower thresholds of $\theta_h$ and $\theta_l$. This is carried out with the help of a flag updated at each frame position as $$CVR(n)=1,\ dF_c(n)>\theta_h$$

$$0,\ dF_c(n)<\theta_l$$

$$CVR(n-1),\ \theta_l\leq dF_c(n)\leq\theta_h \tag{4}$$

The threshold values of 350 Hz and 300 Hz are selected as $\theta_h$ and $\theta_l$, respectively. Hysteresis based thresholding with these values prevents momentary fluctuations in $dF_c(n)$ from triggering CVR modification, without missing actual transitions. The maximum gain for enhancing the segment is set as $A_m$ subject to the condition that the energy of the frame after its amplification does not exceed the peak energy $E_p(n)$. The maximum gain for a frame is calculated by the following equation:

$$G_m(n)=\min[A_m,\ (E_p(n)/E_s(n))^{1/2}] \tag{5}$$

To avoid perceptible distortions caused by abrupt changes, the gain is changed from the current value to the target value in p logarithmic steps of y given as the following:

$$\gamma=[G_m(n)]^{1/p} \tag{6}$$

The gain to be applied is calculated as the following:

$$G(n)=\min[G(n-1)\gamma,\ G_m(n)],\ CVR(n)=1$$

$$\max[G(n-1)/\gamma,\ 1]\ \text{otherwise} \tag{7}$$

To provide significant enhancement of the transient segments without introducing perceptible distortions, maximum gain of 9 dB (i.e. $A_m$=2.82) is applied and p is selected as 3.

In the gain application path 210, the signal delay block 211 introduces a delay to approximately compensate for the delay in the detection of the spectral transitions. In the preferred embodiment with K=L=M=20, this delay is kept at 10 ms. The delayed signal is multiplied by the gain G(n) to get the CVR modified signal 141 as the output.

Figure 3:
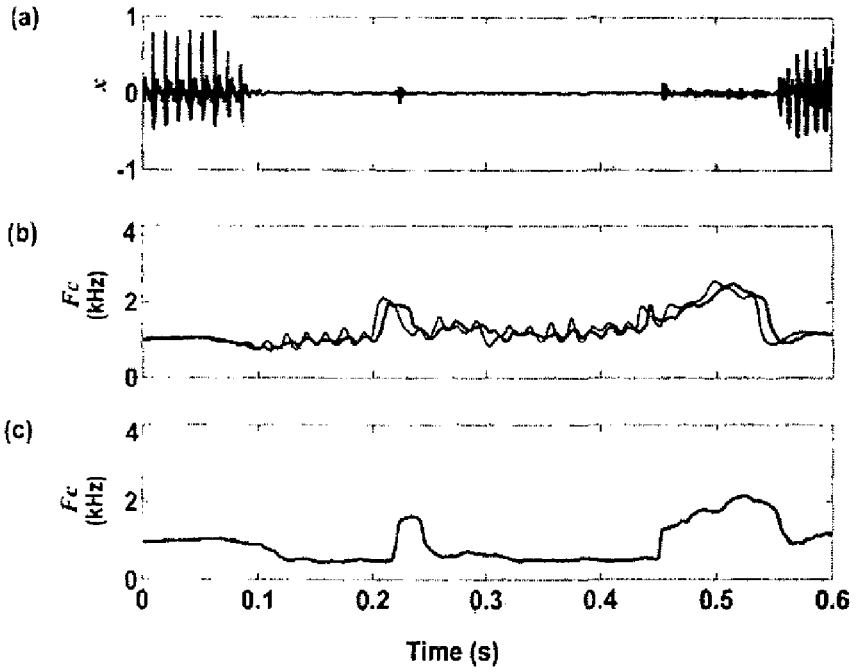
FIG. 3 shows an example of spectral centroid estimation in accordance with an aspect of the present invention.

FIG. 3 shows an example of spectral centroid estimation. Panel-a of the figure shows the waveform of the underlined part of the utterance "you will mark pa please" with burst release of /k/ at 0.225 s followed by that of /p/. Panel-b of the figure shows the spectral centroid $F_c$. The centroid plot with the thick curve is obtained using 20-frame averaging of 6 ms frames, while the plot with the thin curve is obtained using 25 ms frames without averaging. Both plots show the centroid values of nearly 1 kHz during the vowel segments and 2-3 kHz during bursts. The shorter duration frame is seen to better track the sharp transitions. The centroid values show significant fluctuations during segments with very low energy such as silences and stop closures, adversely affecting its usefulness for detection of releases of closures of stops and onsets of fricatives. Addition of a continuous 100 Hz tone at −20 dB with respect to the maximum signal level in the utterance approximately simulates the presence of voice bar during stop closures and stabilizes the centroid during silences and stop closures, without masking its transitions during closure releases and frication onsets. Panel-c of the figure shows a plot of spectral centroid with 100 Hz tone added to speech at −20 dB. Its value is low and stable during silences and stop closures, and sharp changes in its value are related to major transitions in the vocal tract configuration. Assuming the spectral centroid to be capturing the overall variation in spectral resonances, its rate of change is used to detect sharp spectral transitions.

Figure 4:
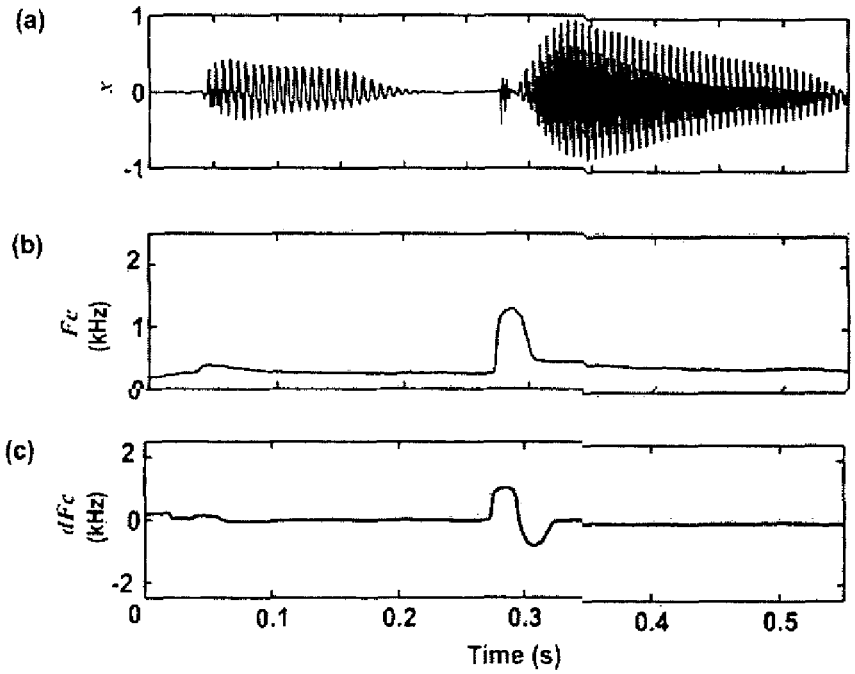
FIG. 4 shows an example of calculation of first difference of spectral centroid in accordance with an aspect of the present invention.

FIG. 4 shows an example of calculation of first difference of spectral centroid. Panel-a of the figure shows the waveform of the VCV utterance /ubu/. Panel-b of the figure shows the spectral centroid $F_c$ calculated using Equation-1. Panel-c of the figure shows the first difference $dF_c$. The rate of change of centroid is computed using a first difference with time-step K corresponding to 20 ms by using Equation-2. The centroid plots are relatively insensitive to the variations in the signal level.

Figure 5:
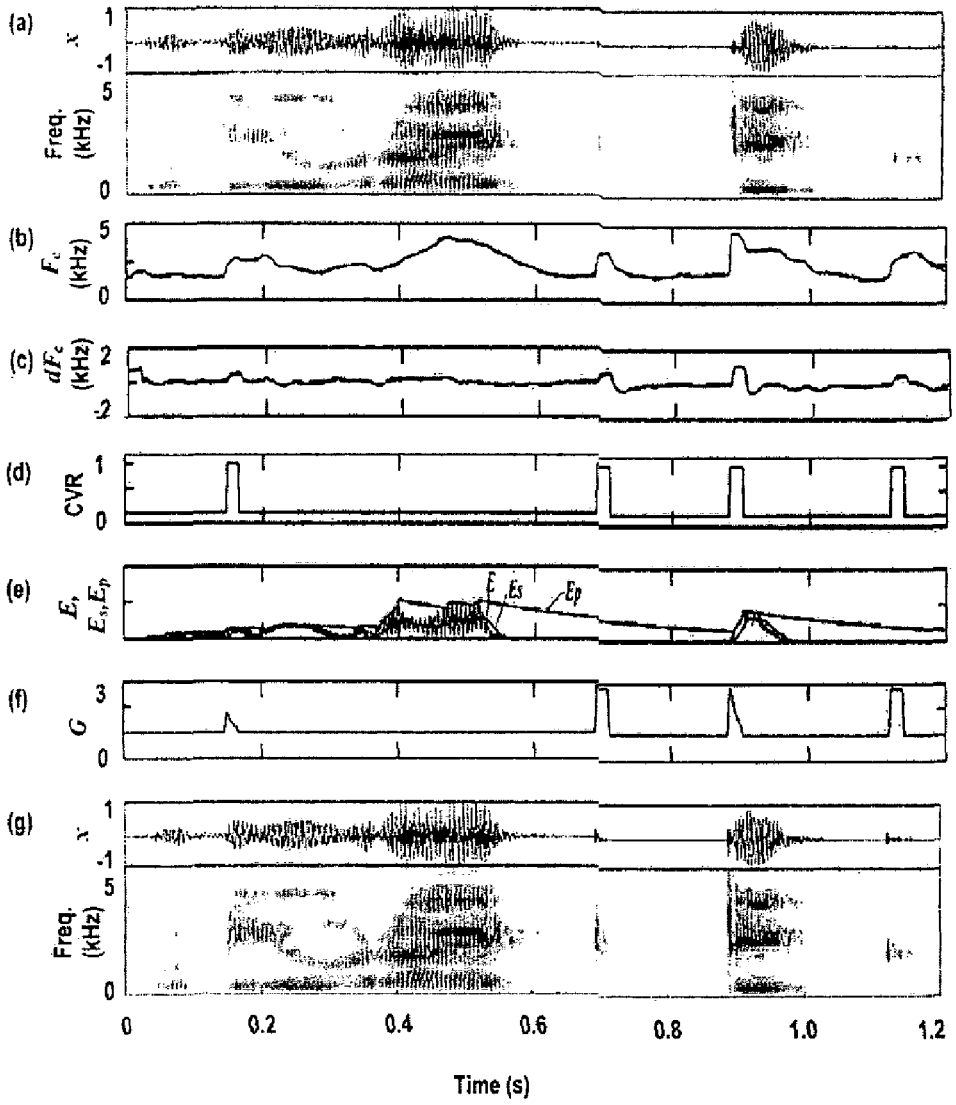
FIG. 5 shows an example of CVR modification in accordance with an aspect of the present invention.

FIG. 5 illustrates plots of an example of CVR modification performed on an utterance "would you write tick". Panel-a of the figure shows a plot of speech signal and its spectrogram. Panel-b of the figure shows a plot of spectral centroid $F_c(n)$ of the input speech signal. Panel-c shows the corresponding first difference $dF_c(n)$. Panel-d of the figure shows a plot of the CVR modification flag. It is seen that the burst onsets are selected for CVR modification. Panel-e of the figure shows a plot of the energy parameters E, $E_s$, and $E_p$. Panel-f of the figure shows a plot of the gain for CVR modification. Panel-g of the figure shows the modified output signal and its spectrogram. It is seen that the gain is applied during onsets with sharp spectral changes and the duration for which gain is applied is limited by the interval over which $dF_c(n)$ remains above the threshold frequency of 300 Hz after crossing the upper threshold frequency of 350 Hz. It is also seen that the amount of gain applied is nearly 9 dB for onsets preceded by a closure interval. The use of comparatively lower threshold frequencies enables detection of abrupt onsets other than the burst and frication onsets. The gain applied during such segments are generally low because of the lower ratio of peak energy $E_p$ and smoothened energy $E_s$ and the intensity modification of these segments are not detrimental to speech intelligibility.

The processing method has been validated by conducting listening tests for recognition of consonants in consonant-vowel, vowel-consonant, and consonant-vowel-consonant word lists and speech-spectrum shaped noise as a masker. The improvements in consonant recognition scores correspond to an SNR advantage of 2-6 dB.

Figure 6:
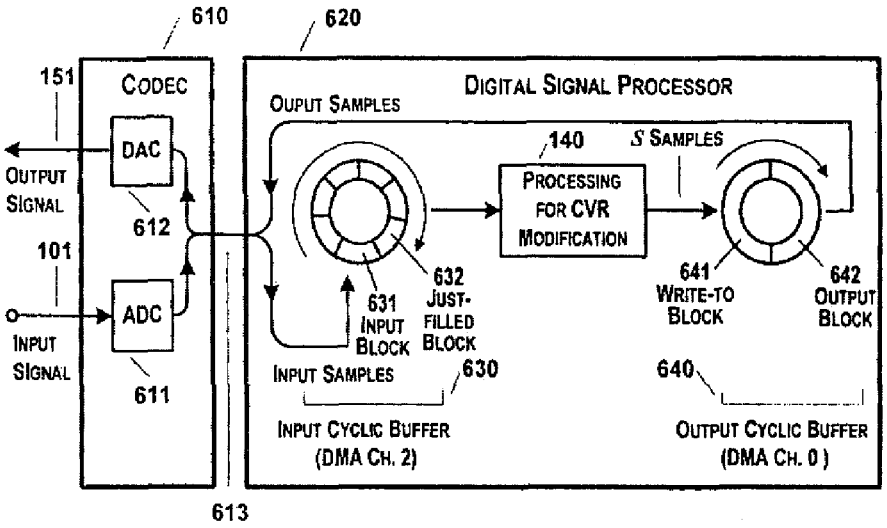
FIG. 6 is a schematic illustration of implementation of automated CVR modification for real-time processing using a DSP board in accordance with an aspect of the present invention.

FIG. 6 illustrates a block diagram of a preferred embodiment of the system for real-time CVR modification. It comprises a codec 610 with ADC 611 and DAC 612 and digital signal processor (DSP) 620. The codec 610 is interfaced to the DSP 620 through a serial interface 613. As an example, the technique is implemented for real-time processing using a DSP board "Spectrum Digital eZdsp" based on a 16-bit fixed-point processor "TI TMS320C5515". The board has 4 MB flash memory for user program and programmable stereo audio codec "TI TLV320AIC3204". The processor can operate up to a clock frequency of 120 MHz and has 16 MB address space with 320 KB on-chip RAM including 64 KB dual-access data RAM. Its other important features include DMA controllers, 32-bit timers, and on-chip FFT hardware accelerator supporting up to 1024-point FFT computation. The program has been written in C using "TI Code Composer Studio version 4.0". The processor clock frequency is set at 120 MHz and only one channel of the stereo codec is used with 16-bit quantization and a sampling frequency of 10 kHz.

The data transfer and buffering operations are interrupt driven and are devised for an efficient realization of the processing with analysis frame of 6 ms and frame shift of 1 ms. As shown in FIG. 6, the input-output operations are handled using two DMA channels and two cyclic buffers, comprising input cyclic buffer 630 and output cyclic buffer 640 having 7 and 2 data blocks, respectively. The size of each of these blocks is S samples, with S set as 10 samples corresponding to frame shift 1 ms for $f_s$ of 10 kHz. DMA channel-2 reads the input samples from ADC 611 into the current input data block 631 of the input cyclic buffer 630 and DMA channel-0 writes the processed samples from the current output data block 642 of the output cyclic buffer 640 to DAC 612. Cyclically incremented pointers keep track of current input data block 631, just-filled input data block 632, current output data block 642, and write-to output data block 641. In the signal processing block 140 for CVR modification, 512-sample buffer initialized with zero values is used as the input buffer. When the current input data block gets filled, DMA interrupt is generated. At each interrupt, the samples in the six blocks of the input cyclic buffer 630 are transferred to the input data buffer, and the processed S samples are transferred to the write-to data block 641 of the output cyclic buffer 640, and the cyclic pointers are updated.

The processing steps in CVR modification block 140 are the same as shown in FIG. 1, with due care of the constraints of fixed-point arithmetic, use of cyclic buffers for realizing delay lines, and utilization of the processor features to complete the processing of each frame within the frame shift duration. The energy E(n) of the current frame is calculated and stored in a 20-sample cyclic buffer. The mean value of these samples is calculated as smoothened energy $E_s(n)$. The peak energy $E_p(n)$ is calculated using Equation-3, with $\alpha=255/256$ as an approximation to $(0.5)^{1/200}$ and is used for calculating the scaling factor for the centroid-stabilizing tone to be added to the signal. The pre-stored samples of the tone with energy $E_t$ are multiplied by $\beta=(E_p/(100E_t)^{0.5}$ and added to the signal samples. A Hanning window is applied on the frame, and the magnitude spectrum is calculated using 512-point FFT and stored in a 20-frame circular buffer. Smoothened spectrum is calculated by ensemble averaging and is used to calculate the centroid which is stored in a 20-sample circular buffer. A 20-point median of these values is calculated as the centroid $F_c$ of the current frame, stored in a 20-sample circular buffer, and used to calculate 20-point first difference. The value of the CVR modification flag is determined using hysteresis comparison as given in Equation-4 and is used in calculating the gain factor G(n) using Equation-5, Equation-6, and Equation-7. The last step of the processing involves multiplication of the ten samples of the input with the gain factor and outputting them. The delay in the signal path to compensate for the delay in the detection of spectral transitions is realized using a 10-block cyclic buffer. A scaling factor of 64 is used during gain calculation for improving the precision during fixed-point arithmetic. The same factor is used to scale down the values after multiplication of the delayed input samples with the gain factor. The processing involves algorithmic delay of 10 ms and computational delay of 1 ms.

Figure 7:
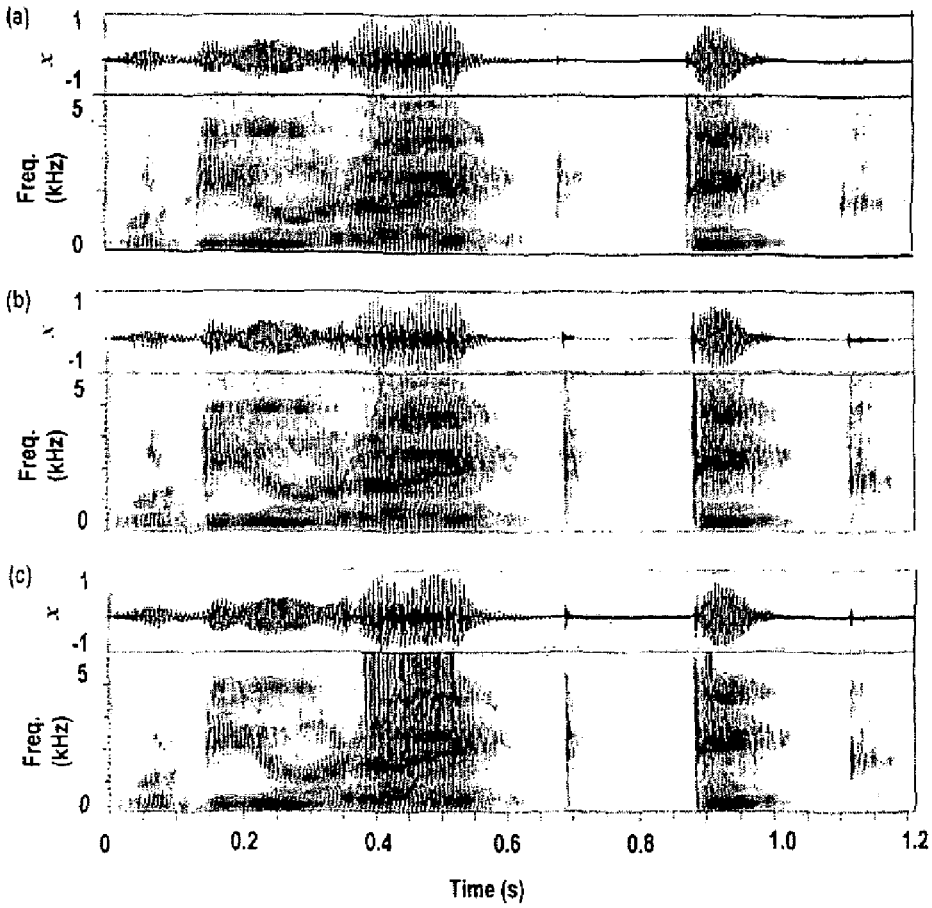
FIG. 7 shows an example of offline and real-time processing for CVR modification in accordance with an aspect of the present invention.

The processed outputs from the real-time processing system with the fixed-point processor described above with reference to FIG. 6 were found to be perceptually similar to the corresponding outputs from floating-point based offline processing. FIG. 7 shows an example of offline and real-time processing for CVR modification. Panel-a of the figure shows waveform and spectrogram of the utterance "would you write tick" applied as input. Panel-b of the figure shows a plot of the offline processed output signal and its spectrogram. Panel-c of the figure shows real-time processed output signal and its spectrogram. Mean value of correlation coefficients between the short-time energy envelopes of the two outputs, for a set of 36 test sentences as the input, was 0.98 and the result confirms the suitability of the method for implementation using fixed-point arithmetic.

The invention has been described above with reference to its application in communication devices and hearing aids, wherein the analog input signal is processed to generate analog output signal using a processor interfaced to ADC and DAC. An example of the preferred embodiment is described using a 16-bit fixed-point DSP chip with on-chip FFT hardware and interfaced to a codec chip (with ADC and DAC) through serial data interface and DMA. The method can also be implemented using processors with other architectures and other types of interface to ADC and DAC, or using a processor with on-chip ADC and DAC. The processor chip used need not have on-chip FFT hardware if it has sufficiently high processing speed to implement the technique. The method described in this disclosure can also be used in communication devices with a processor operating on digitized speech signals available in the form of digital samples at regular intervals or in the form of data packets. In addition to its application in hearing aids and communication devices, the invention can also be used in applications like public address systems and other audio systems to improve speech intelligibility under various background noise and distortions.

The above description along with the accompanying drawings is intended to be illustrative and should not be interpreted as limiting the scope of the invention. Those skilled in the art to which the invention relates will appreciate that many variations of the described example implementations and other implementations exist within the scope of the claimed invention.

We claim:

1. A method for processing, in real time, a digital speech signal for consonant-vowel ratio (CVR) modification using a digital processor, the method comprising:

detecting perceptually salient segments in said digital speech signal;

calculating a time-varying gain in accordance with a location and energy of the detected segments in the digital speech signal; and applying said time-varying gain to said digital speech signal to produce a processed digital speech signal without significantly increasing a loudness level of said digital speech signal, wherein detecting, calculating, and applying further comprises:

windowing samples of said digital speech signal to form overlapping frames and calculating energy of said frames;

smoothening said frame energy by a moving-average filter to obtain smoothened short-time energy;

applying a peak detector with exponential decay on said frame energy to track peak energy;

generating a low-frequency tone and multiplying said low-frequency tone with said peak energy and adding a resulting scaled tone to said digital speech signal to obtain a tone-added signal;

windowing said tone-added signal and applying Discrete Fourier transform (DFT) to obtain short-time magnitude spectrum of said tone-added signal;

applying a moving-average filter on said short-time magnitude spectrum to obtain a smoothened short-time magnitude spectrum;

calculating a spectral centroid of said smoothened short-time magnitude spectrum;

smoothening said spectral centroid by median filtering to obtain a smoothened spectral centroid;

calculating a first-difference of said smoothened spectral centroid to obtain a rate of change of said smoothened spectral centroid; and selecting said time-varying gain using said smoothened short-time energy, said peak energy, and said rate of change of said smoothened spectral centroid, wherein said rate of change of said smoothened spectral centroid of said digital speech signal is used to detect said perceptually salient segments with sharp spectral transitions to avoid effects of speaker variability.

2. The method as claimed in claim 1, wherein said perceptually salient segments for modification comprise sharp spectral transitions associated with major changes in a vocal tract configuration and occur at a release of closures in stops and affricates and in fricatives and nasals.

3. The method as claimed in claim 1, wherein said peak detector with exponential decay tracks a vowel energy and retains it during one or more of stop closures and low energy clusters.

4. The method as claimed in claim 1, wherein said spectral centroid is calculated from said short-time magnitude spectrum of said digital speech signal added with said low-frequency tone for reducing insertion errors in the detection of said perceptually salient segments.

5. The method as claimed in claim 1, wherein said spectral centroid is smoothened by said median filter for suppressing ripples without significantly smearing changes corresponding to major spectral transitions.

6. The method as claimed in claim 1, wherein said perceptually salient segments are enhanced by said time-varying gain to reduce computational complexity and memory requirement associated with labelling of the segments and analysis-synthesis based processing.

7. The method as claimed in claim 1, wherein said gain to be applied at a frame position is calculated using said rate of change of said smoothened spectral centroid, said smoothened short-time energy, and said peak energy.

8. The method as claimed in claim 7, wherein said gain is selected using a hysteresis-based thresholding of rate of change of said smoothened spectral centroid for detection of sharp spectral transitions with a high temporal accuracy and low insertion error.

9. The method as claimed in claim 7, wherein said gain is selected to keep a signal level of said perceptually salient segment below that of a preceding vowel.

10. The method as claimed in claim 7, wherein said gain is changed from a current value to a target value in logarithmic steps to avoid perceptible distortions caused by abrupt changes in the signal level.

11. The method as claimed in claim 1, wherein an output signal is obtained by multiplying said time-varying gain with said digital speech signal which is delayed to compensate for a processing delay in selection of said time-varying gain.

12. A system for processing in real time a digital speech signal for consonant-vowel ratio (CVR) modification, wherein the digital speech signal is available in the form of digital samples at regular intervals or in the form of data packets, the system comprising:

a digital input-output port configured to receive said digital speech signal and output a processed digital speech signal; and a digital processor interfaced to said digital input-output port configured to process said digital speech signal;

wherein said digital speech signal is processed using a method comprising:

detecting perceptually salient segments in said digital speech signal;

calculating a time-varying gain in accordance with a location and energy of the detected segments in the digital speech signal; and applying said time-varying gain to said digital speech signal to produce a processed digital speech signal without significantly increasing a loudness level of said digital speech signal, wherein detecting, calculating, and applying further comprises:

windowing samples of said digital speech signal to form overlapping frames and calculating energy of said frames;

smoothening said frame energy by a moving-average filter to obtain smoothened short-time energy;

applying a peak detector with exponential decay on said frame energy to track peak energy;

generating a low-frequency tone and multiplying said low-frequency tone with said peak energy and adding a resulting scaled tone to said digital speech signal to obtain a tone-added signal;

windowing said tone-added signal and applying Discrete Fourier transform (DFT) to obtain short-time magnitude spectrum of said tone-added signal;

applying a moving-average filter on said short-time magnitude spectrum to obtain a smoothened short-time magnitude spectrum;

calculating a spectral centroid of said smoothened short-time magnitude spectrum;

smoothening said spectral centroid by median filtering to obtain a smoothened spectral centroid;

calculating a first-difference of said smoothened spectral centroid to obtain a rate of change of said smoothened spectral centroid; and selecting said time-varying gain using said smoothened short-time energy, said peak energy, and said rate of change of said smoothened spectral centroid, and wherein said rate of change of said smoothened spectral centroid of said digital speech signal is used to detect said perceptually salient segments with sharp spectral transitions to avoid effects of speaker variability.

13. A system for processing an input analog speech signal for consonant-vowel ratio (CVR) modification, the system comprising:

an analog-to-digital converter configured to convert said input analog speech signal to a digital speech signal;

a digital signal processor configured to process said digital speech signal; and a digital-to-analog converter configured to convert the processed digital speech signal as an output analog speech signal, wherein said digital speech signal is processed using a method comprising:

detecting perceptually salient segments in said digital speech signal;

calculating a time-varying gain in accordance with a location and energy of the detected segments in the digital speech signal; and applying said time-varying gain to said digital speech signal to produce a processed digital speech signal without significantly increasing a loudness level of said digital speech signal, wherein detecting, calculating, and applying further comprises:

windowing samples of said digital speech signal to form overlapping frames and calculating energy of said frames;

smoothening said frame energy by a moving-average filter to obtain smoothened short-time energy;

applying a peak detector with exponential decay on said frame energy to track peak energy;

generating a low-frequency tone and multiplying said low-frequency tone with said peak energy and adding a resulting scaled tone to said digital speech signal to obtain a tone-added signal;

windowing said tone-added signal and applying Discrete Fourier transform (DFT) to obtain short-time magnitude spectrum of said tone-added signal;

applying a moving-average filter on said short-time magnitude spectrum to obtain a smoothened short-time magnitude spectrum;

calculating a spectral centroid of said smoothened short-time magnitude spectrum;

smoothening said spectral centroid by median filtering to obtain a smoothened spectral centroid;

calculating a first-difference of said smoothened spectral centroid to obtain a rate of change of said smoothened spectral centroid; and selecting said time-varying gain using said smoothened short-time energy, said peak energy, and said rate of change of said smoothened spectral centroid, and wherein said rate of change of said smoothened spectral centroid of said digital speech signal is used to detect said perceptually salient segments with sharp spectral transitions to avoid effects of speaker variability.

14. The system as claimed in claim 13, wherein said digital signal processor comprises on-chip FFT hardware and said analog-to-digital converter and said digital-to-analog converter are configured for signal input and output operations, respectively, using DMA (direct memory access) and cyclic buffering for computationally efficient processing.

* * * * *